United States Patent [19]

Aldridge

[11] Patent Number: 5,071,098

[45] Date of Patent: Dec. 10, 1991

[54] CHRISTMAS TREE ORNAMENT SHELF ASSEMBLIES

[76] Inventor: Robert E. Aldridge, 14615 SW. Carolwood Dr., Beaverton, Oreg. 97007

[21] Appl. No.: 632,628

[22] Filed: Dec. 26, 1990

Related U.S. Application Data

[63] Continuation of Ser. No. 397,195, Aug. 23, 1989, abandoned.

[51] Int. Cl.[5] ..... F16M 11/00

[52] U.S. Cl. ..... 248/219.4; 248/219.2; 248/284

[58] Field of Search ..... 248/219.42, 219.4, 205.2, 248/231, 284; 108/151, 152; 182/187

[56] References Cited

U.S. PATENT DOCUMENTS

| | | | |
|---|---|---|---|
| 604,008 | 5/1898 | Hughes | 248/284 X |
| 1,408,900 | 3/1922 | Miller et al. | 248/231 |
| 1,759,966 | 5/1930 | Swinney | 182/187 |
| 2,270,948 | 1/1942 | Howe | 248/284 X |
| 2,453,695 | 11/1948 | Belling | 240/10 |
| 2,683,210 | 7/1954 | Baenziger | 240/10 |
| 2,759,095 | 8/1956 | Kline | 240/10 |
| 2,802,095 | 8/1957 | Denning et al. | 240/10 |
| 3,000,512 | 9/1961 | Maynor | 108/151 |
| 3,296,430 | 1/1967 | Eckert | 240/10 |
| 3,402,908 | 9/1968 | Gill | 248/231 |
| 4,290,504 | 9/1981 | Cuba | 182/129 X |
| 4,409,907 | 10/1983 | Norton | 108/152 |
| 4,462,065 | 7/1984 | Rhodes | 362/250 |
| 4,582,168 | 5/1986 | Frey | 182/187 |
| 4,640,483 | 2/1987 | Tufte | 248/231 X |

*Primary Examiner*—Karen J. Chotkowski

*Attorney, Agent, or Firm*—Eugene M. Eckelman

[57] ABSTRACT

A platform has a top surface on which an ornament is arranged to be seated. This platform is used on laterally extending arms which hold the lower ornaments and is also used on a top mount. In each case, the platform is supported by the trunk of the tree whereby to provide a good solid support for ornaments. The laterally extending arms have adjustment structure therein to position the platform in suitable positions relative to the tree. Each of the laterally extending arms and the top assembly are held in position by a Velcro-type band extending around the tree trunk.

2 Claims, 2 Drawing Sheets

CHRISTMAS TREE ORNAMENT SHELF ASSEMBLIES

This application is a continuation, of application Ser. No. 07/397,195, filed 8/23/89 and now abandoned.

BACKGROUND OF THE INVENTION

This invention relates to new and useful improvements in Christmas tree ornament shelf assemblies.

Various forms of Christmas tree decorations have been used. Such decorations are generally supported on the branches of the tree and the weight thereof frequently puts a load on the branches that detracts from the appearance of the tree. Also, using the branches as the support for decorations amounts to a limitation to the overall decoration function because the branches can only hold a limited amount of weight. The trunk of the tree is usually very sturdy and capable of supporting various items intended for decorating the tree, but devices have not heretofore been conceived which use the trunk as the support and which at the same time are capable of supporting decorations in an attractive and versatile manner. U.S. Pat. No. 2,759,095 shows a trunk supported lighting harness for Christmas trees that utilizes the trunk to support the base of the wires. The lightbulb laterals which extend from the base are hung on the tree branches. A similar broad concept is shown in U.S. Pat. No. 2,453,695. U.S. Pat. No. 2,802,095 shows rigid bracket means for Christmas tree lights but there is no provision for supporting decorations. Also the brackets are secured to the tree limbs and have suspended support by straps connected to the trunk of the tree. Light support arms leading from the tree trunk in artificial type Christmas trees, such as illustrated in U.S. Pat. Nos. 2,683,210 and 3,296,430 have been devised, but such devices are not intended for supporting decorations on Christmas trees of the type having flexible limbs.

SUMMARY OF THE INVENTION

In accordance with the invention, it is an objective thereof to provide ornament shelf assemblies arranged to be attached to those types of Christmas trees that have flexible branches, said shelf assemblies being capable of having full support on the trunk of the tree.

Another object is to provide a Christmas tree ornament shelf assembly that incorporates adjustment means within its length by means of which an ornament receiving platform thereon can be positioned in different planes and positions.

Another object of the invention is to provide side and top tree ornament shelf assemblies that include a novel platform structure as the supporting surface for ornaments.

In carrying out the objectives of the invention, the Christmas tree ornament shelf assemblies comprise platform holding arms that project laterally from the trunk to the side edges of the tree and a platform holding assembly clamped to the top of the tree. The laterally projecting arms include an inner end having releasable attachment to the trunk of the tree and an outer end that releasably supports the ornament holding platform. These arms have means incorporated therein facilitating a universal-type adjustment for the platform. The top shelf assembly is clamped to the top of the tree by depending legs which straddle the trunk. Each of the side and top ornament shelf assemblies is releasably secured to the tree trunk.

The invention will be better understood and additional objects and advantages will become apparent from the following description taken in connection with the accompanying drawings.

DETAILED DESCRIPTION OF A PREFERRED EMBODIMENT

Figure 1:
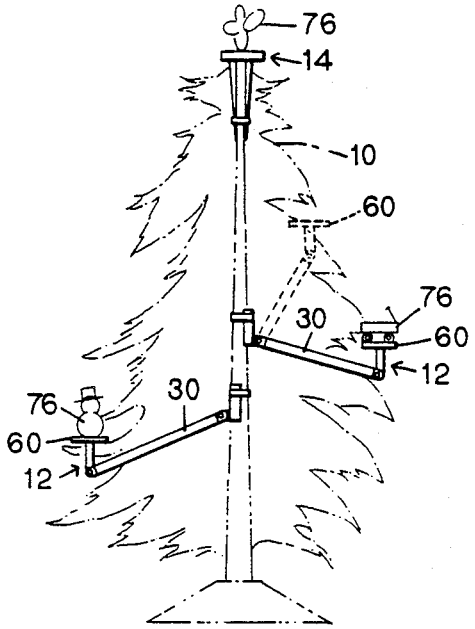
FIG. 1 is an elevational view of a Christmas tree showing the side and top ornament shelf assemblies of the present invention in place on the tree, the tree being shown in phantom lines.

With reference to FIG. 1, the invention is designed for use with Christmas trees 10 of the natural tree type or an artificial type utilizing life-like branches, or branches that will not bear any substantial weight. The concept of the invention utilizes a first ornament shelf assembly 12 comprising lateral means extending to the sides of the tree and a top shelf assembly 14. In each case, these members have full support on the trunk of the tree.

Figure 2:
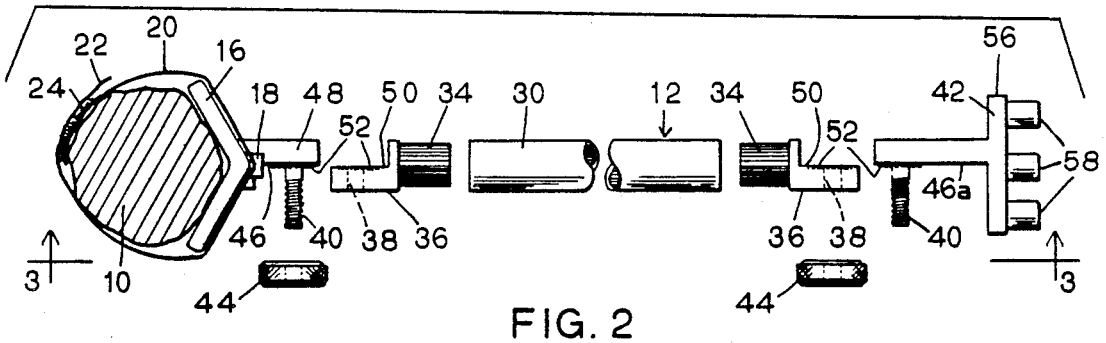
FIG. 2 is an exploded top plan view of one of the laterally extending ornament shelf assembly arms, the ornament support platform being omitted from the outer end of the arm to show releasable support structure for the platform.
Figure 3:
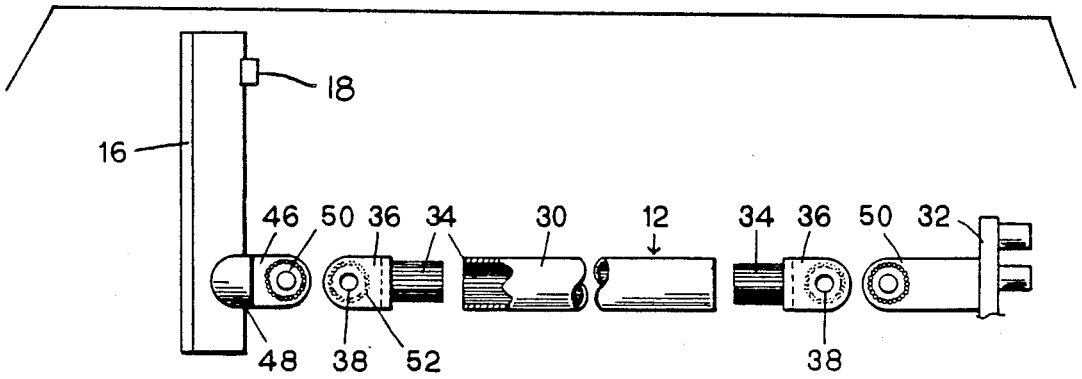
FIG. 3 is a side elevational view of one of the shelf assembly arms of the invention, this view being taken on the line 3—3 of FIG. 2.
Figure 4:
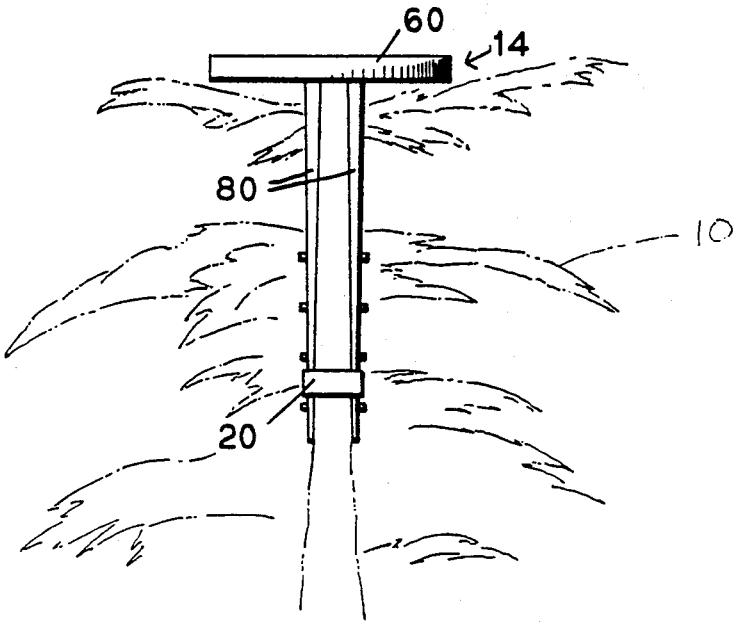
FIG. 4 is an elevational view of a top portion of a Christmas tree showing the top shelf assembly in more detail, the tree in this view also being shown in phantom lines.

With particular reference to FIGS. 2 and 3, the side shelf assemblies comprise a vertical V-shaped base member 16 arranged to straddle the trunk of a Christmas tree. Base member 16 has a bead 18 on the rear or peaked surface thereof. This bead is disposed adjacent the upper end of the base member for retaining a flexible band 20, such as a Velcro type band, having connecting ends 22 and 24 providing adjustable and releasable locking support of the base member against the tree trunk. Base 16 is elongated so as to provide good vertical stabilization of the laterally projecting support 12 against the tree trunk.

The shelf assemblies 12 include an intermediate rod-like arm portion 30 of a suitable length to reach the outer confines of the tree in cantilevered lateral projection. This arm portion has axial adjustment means incorporated therein comprising spline-like connections 34 at its opposite ends with short connectors 36. The two connectors 36 of each shelf assembly 12 have horizontal bores 38 arranged to freely receive horizontal threaded studs 40 on each of the base member 16 and a platform base 42 at the outer end of the shelf assembly. Each of the studs 40 is associated with a locking hand nut 44. The stud 40 on the base member 16 leads from a flat surface 46 of a projection 48 extending integrally from a lower portion of the base member 16, and the stud 40 on the platform base 42 leads from a flat surface 46a of this base. The connectors 36 have offset flat faces 50 arranged for engagement with flat faces 46 and 46a of the base member 16 and the platform base respectively. The faces 46, 46a and 50 have interengageable locking projections and detents 52 capable of holding the arm portion 30 and platform base 42 in respective adjusted angular positions on the horizontal stud 40. A universal support of the platform base 42 is thus accomplished, namely, by rotative positioning of the inner connector 36 on the stud 40 of the base member 16, by rotative splined positioning of the arm portion 30 on the inner connector 36, by rotative spline positioning of the outer connector 36 on the arm portion 30, and by rotative positioning of the platform base 42 on the stud 40 of the outer connector 36. FIG. 1 shows in full and dotted lines representative positions of the side shelf assembly 12.

Figure 5:
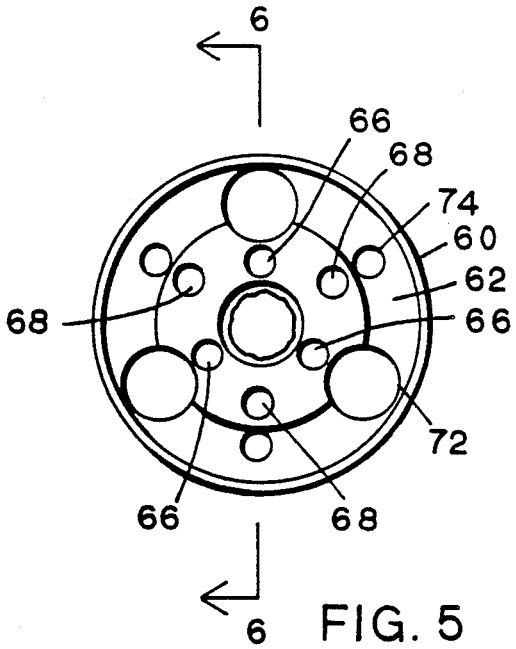
FIG. 5 is a bottom plan view of the platform that supports the ornaments.
Figure 6:
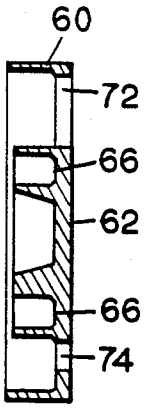
FIG. 6 is a sectional view taken on the line 6—6 of FIG. 5.

Platform base 42 has a cross head portion 56 with three face prongs 58. A platform 60, FIGS. 5 and 6, is arranged to be releasably supported on the platform base 42 and comprises a flat surface portion 62 which provides the support surface for ornaments. Three sockets, identified by the numeral 66, are formed in the bottom surface of the platform 60 and have spacing, location and size relative to the prongs 58 on the platform base 42 as to have snap-in releasable connection with such prongs. Three additional sockets 68 are provided in the bottom of the platform 60 for providing an alternative and wider support for the platform if necessary. In addition, large and small bores 72 and 74, respectively, such as three or more in number, may be provided through the surface 62 of the platform 60. The large bores 72 allow Christmas tree lights or similar strings of decorations to be threaded therethrough. The smaller bores 74 comprise mount holes for ornaments 76, FIG. 1. Such mounting of ornaments may comprise friction attachment or the use of any suitable fastener.

Figure 7:
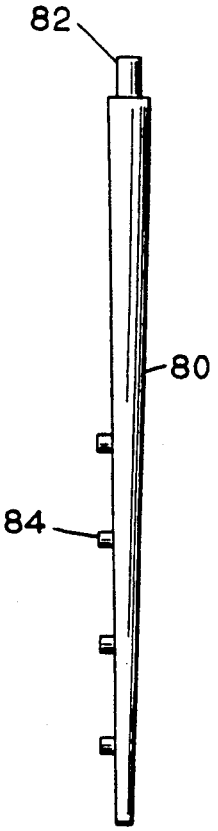
FIG. 7 is an elevational view of a trunk clamp leg used with the top shelf assembly.

The same platform structure 60 that is used with the side shelf assemblies is used with the top shelf assembly 14. This assembly includes three legs 80, FIGS. 1 and 7, having a prong end 82 dimensioned for snap-in engagement with the sockets 66 or 68 in the platform. For installing the top shelf assembly, the top of the tree is cut off, and the platform 60 is placed in overlying relation to this top end with the legs 80 straddling the trunk. Any three of the sockets 66 or 68 or a combination of the two can be used at a time, depending on the size and shape of the tree top. A flexible band 20, such as a Velcro-type band as used with the side shelf assembly, is wrapped around the lower portion of the legs 80 to bind the legs against the tree trunk. Legs 80 may have spaced beads 86 for confining the band 20. A top ornament 76 can be seated on the top shelf assembly 14 and secured in place if desired by fastening means associated with one or more of the bores 74.

Thus, according to the invention, ornament shelf means are provided that are supported entirely by the trunk of the tree rather than by the branches. Ornaments can thus be selectively arranged regardless of the branch configuration, and furthermore heavier and bulkier type ornaments can be used. By suitable adjustments of the parts that make up the side shelf assemblies 12, the platforms 60 can be selectively positioned at any elevation or in any plane. Also, instead of using the top ornament assembly 14, one of the laterally projecting arm assemblies 12 can be mounted a selected distance from the top and then rotatably adjusted to a vertical position such that it holds its platform at the top of the tree. One length of arm can accommodate many outer peripheral distances of the tree by selected angular disposition of such arm, as illustrated in FIG. 1, or if desired, the arms 30 can be cut to suitable length.

It is to be understood that the forms of my invention herein shown and described is to be taken as a preferred example of the same and that various changes in the shape, size and arrangement of parts may be resorted to without departing from the spirit of my invention, or the scope of the subjoined claims.

Having thus described my invention, I claim:

1. In combination, a Christmas tree of the type having a sturdy trunk, laterally extending branches and a top portion;

a plurality of platforms having ornament support surfaces thereon, first platform support means comprising at least one elongated arm having inner and outer ends and a longitudinal axis, means at the inner end of said arm connecting said arm to the trunk of said Christmas tree and supporting said arm in cantilevered lateral projection from the trunk, means on the outer end of said arm connected to at least one of said platforms for supporting said platform, said arm being of a length that supports said platform adjacent an outer portion of branches of said tree whereby ornaments can be supported at the outer portion of said tree, second platform support means arranged to support one of said platforms on the top of said tree and comprising at least three legs depending from said platform and arranged to lie longitudinally along the sides of said tree at the top thereof in peripheral spaced relation, and releasable flexible band means arranged to secure the legs in clamped engagement with the top of said tree.

2. The combination of claim 1 wherein said platform on said arm is pivotally adjustable on the outer end of said arm on the longitudinal axis of said arm for adjusting the plane of support of said ornament support surface of said platform, said arm also being pivotally adjustable on a horizontal axis to adjust the laterally extending angle thereof relative to said tree trunk, and further said arm has a rotatable adjustment on its own longitudinal axis.

* * * * *